United States Patent [19]

Aihara

[11] Patent Number: 4,774,697

[45] Date of Patent: Sep. 27, 1988

[54] ELECTRONIC TIMEPIECE INCLUDING A SCHEDULE MEMORY DEVICE

[75] Inventor: Fumikazu Aihara, Tokyo, Japan

[73] Assignee: Casio Computer Co., Ltd., Tokyo, Japan

[21] Appl. No.: 140,879

[22] Filed: Jan. 6, 1988

Related U.S. Application Data

[63] Continuation of Ser. No. 868,301, May 27, 1986, abandoned.

[30] Foreign Application Priority Data

May 31, 1985 [JP] Japan ..... 60-117750

[51] Int. Cl.[4] ..... G04B 19/24; G04B 45/00

[52] U.S. Cl. ..... 368/41; 368/28; 368/30

[58] Field of Search ..... 368/10, 41, 28, 30

[56] References Cited

U.S. PATENT DOCUMENTS 3,999,050 12/1976 Pitroda ..... 368/10
4,276,541 6/1981 Inoue et al. ..... 382/1
4,293,845 10/1981 Villa et al. ..... 368/10
4,415,271 11/1983 Mori ..... 368/10
4,485,463 11/1984 Kita ..... 368/41

*Primary Examiner*—Bernard Roskoski
*Attorney, Agent, or Firm*—Frishauf, Holtz, Goodman & Woodward

[57] ABSTRACT

In an electronic time-keeping apparatus wherein a plurality of schedule data is stored, chronologically readable, and displayed, schedule data input from a key input section is compared, under control of a read only memory, with a number of schedule data already stored in a random access memory, and edited in a time sequence of recency with a present date as a reference basis to permit the edited schedule data to be stored in this random access memory. A time count operation is performed each time a predetermined timing signal is output from a frequency dividing circuit. A detection is made as to whether or not there is a coincidence between present date data obtained by the time count operation and the edited schedule data stored in the random access memory to see if an appointed date is reached.

18 Claims, 12 Drawing Sheets

AM SUN 1-1
10:58 50
S3

PM TOKYO 1-1
3:35
S3
S2
S2

AM SUN 1-1
11:58 50
S2
S2

PM TOKYO 01-01
03:35

ELECTRONIC TIMEPIECE INCLUDING A SCHEDULE MEMORY DEVICE

This application is a continuation of application Ser. No. 868,301, filed May 27, 1986, now abandoned.

BACKGROUND OF THE INVENTION

This invention relates to an electronic timepiece including a schedule data memory device which can electronically read/write schedule data, such as date, time, scheme and the like.

Conventionally, a schedule display apparatus has been known in the art which stores schedule data, comprised of alarm time data and its corresponding messages in a memory and, when the alarm time is reached, displays the corresponding message. For example, U.S. Pat. No. 4,276,541 discloses an electronic timepiece which, when an alarm time is reachd, displays its corresponding message. In this type of electronic timepiece, since the alarm time is set in a minimal time unit of minutes, it is necessary to detect whether or not the alarm time is reached for every minute. Where, for example, many alarm times are stored in memory, a coincidence detection operation is necessary to set the corresponding alarm time based on a present time, for every minute, resulting in a complex circuit as well as in a greater power dissipation. Where the stored alarm time contains date data in particular, it is also necessary to set not only the time data, but also date data, for detection. As a result, a more complex circuit is required, resulting in a much greater dissipation of power.

SUMMARY OF THE INVENTION

It is accordingly an object of this invention to provide an electronic timepiece including a schedule memory device which, even if a heavy schedule is stored as schedule times, can detect the schedule times through an efficient process and efficiently inform the user of the arrival of a specific schedule time.

According to this invention there is provided an electronic time-keeping apparatus including a schedule memory device, comprising:

time count means for counting reference signals to obtain present date data;

schedule data memory means for storing a number of schedule data comprised of dates and information associated with said dates;

schedule data input means for inputting schedule data to be stored in said schedule data memory means;

schedule data editing means for editing the schedule data input by said schedule data input means and said schedule data previously stored in said schedule data memory means so as to obtain edited schedule data and for storing the edited schedule data in said schedule data memory means, said schedule data editing means permitting the schedule data, including dates following the present date obtained by said time count means, to be edited in a time sequence of recency with said present date as a reference basis;

next schedule memory means for storing address data on the edited schedule data, including date data following and nearest to said present date, contained in the edited schedule data which have been stored in said schedule data memory means by said editing means;

coincidence detection means for detecting a coincidence between said present date data and the date data on the edited schedule data which is located in a memory position designated by the address data obtained by said next schedule memory means and for generating a coincidence signal; and update means for updating the address data of the next schedule memory means on the basis of said coincidence signal.

In the electronic timepiece so constructed, it is only necessary to compare a present time with a schedule time of a schedule so as to detect their coincidence. It is, therefore, possible to obtain the advantages of assuring a simpler arrangement, involving less dissipation power and shortening a coincidence detection time.

BRIEF DESCRIPTION OF THE DRAWINGS

FIGS 9, 9A, 9B, 9C, 9D and 10, each, are a view showing a variation of a display state when a switching operation is effected on the electronic timepiece of FIG. 1;

DETAILED DESCRIPTION OF THE PREFERRED EMBODIMENTS

Electronic Wristwatch

Figure 1:
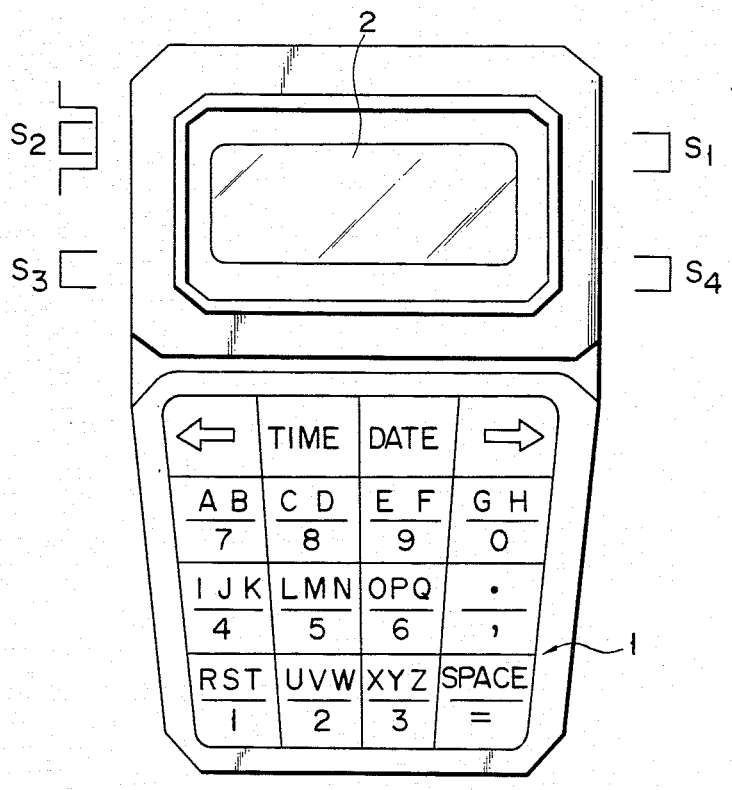
FIG. 1 is a plan view of an electronic timepiece with a display section to which this invention is applied.

FIG. 1 is an outer view showing a schedule memory function-equipped electronic wristwatch to which this invention is applied. Keyboard 1 and display device 2 are provided at the front section of the electronic wristwatch. Various enter keys are mounted on keyboard 1 and function as, for example, alphabet and ten (numeric) keys. Push-button switches $S_1$, $S_2$, $S_3$ and $S_4$ are attached two at one side area, and another two at the other side area of the electronic wristwatch. Here, switch $S_4$ acts as a page alteration switch; switch $S_3$, as a mode switch for switching between a time-keeping mode and a schedule mode; switch $S_2$, as a correction mode changeover switch which is switched over to a time correction mode in a time-keeping mode and to a schedule write mode in the schedule mode; and switch $S_1$, as a correction digit selection switch in the correction mode.

Figure 2:
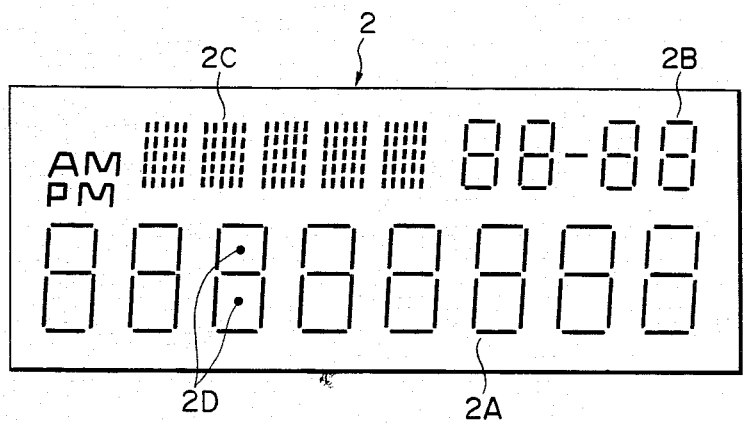
FIG. 2 is an enlarged view of a segment display section in the electronic timepiece of FIG. 1.

FIG. 2 is a detailed arrangement of display device 2. Display device 2 is comprised of a liquid crystal display device having a main digital display section 2A at a lower display area, where display elements are constituted by eight "figure-of-eight" elements. In this auxiliary digital display portion 2A, a colon display 2D is provided. An upper display area of display device 2 includes an auxiliary digital display portion 2B comprised of four "figure-of-eight" display elements, matrix display portion 2C of a five-position type, and "AM" and "PM" display elements, all these being viewed to the left of the drawing sheet (FIG. 1).

Figure 3:
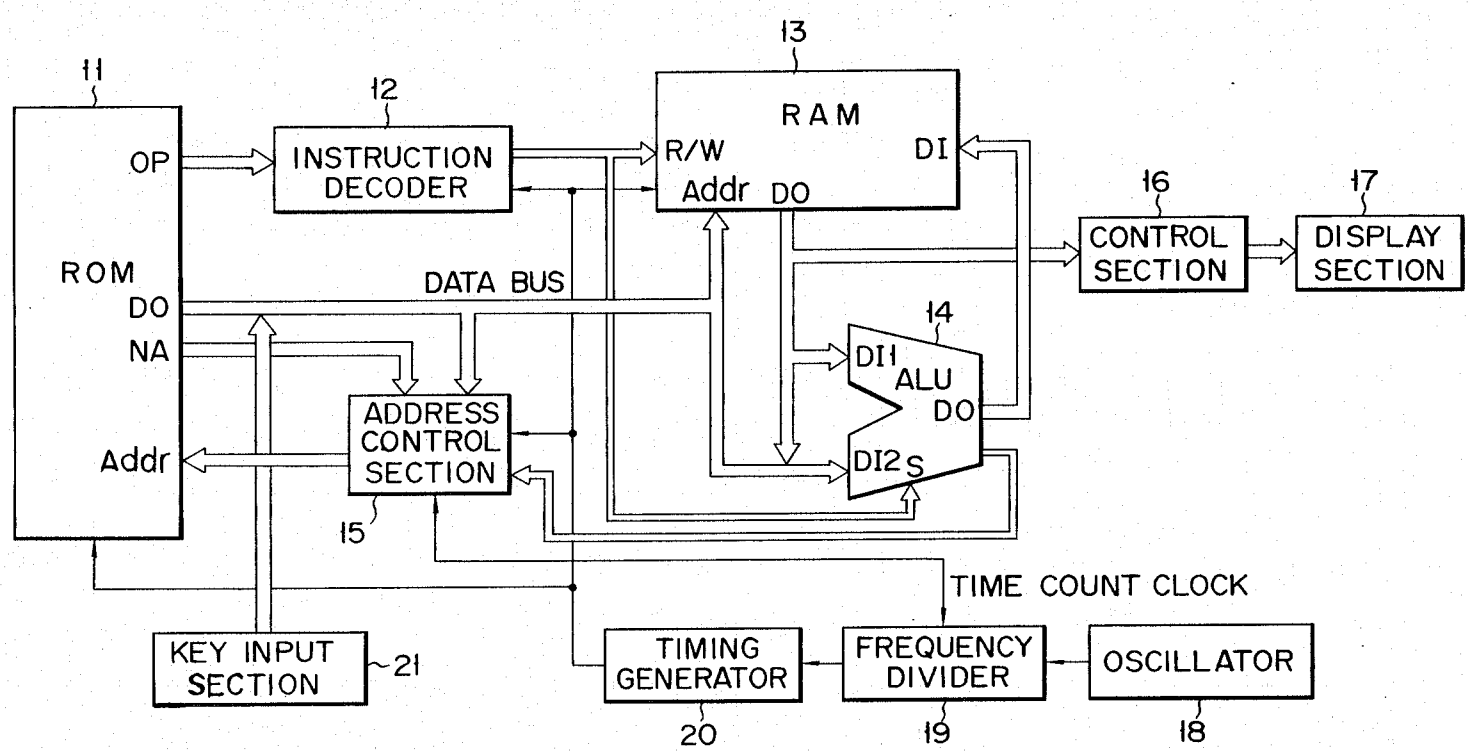
FIG. 3 is a block circuit diagram showing an electronic timepiece of FIG. 1.

The circuit arrangement of the electronic wristwatch will be explained below in connection with FIG. 3.

The electronic wristwatch operates based on an 8-bit parallel-processed microprogram control system, and a ROM (read-only memory) 11 stores a microprogram for controlling all the operations of the electronic wristwatch and delivers microinstructions OP, DO and NA in a parallel fashion. Here, the microinstruction 0P is input to instruction decoder 12 where it is decoded. The output of instruction decoder 12 is fed as a read/write instruction to an R/W input terminal of RAM (random access memory) 13 and also as an arithmetic operation instruction to an "S" input terminal of ALU (arithmetic and logic unit) 14. The microinstruction DO of ROM 11 is supplied as address data to an "Addr" input terminal of RAM 13, to a DI-2 input terminal of ALU 14 and to address control section 15, all via a data bus. Microinstruction NA of ROM 11 is next address data which is input to address control section 15. The output of address control section 15 is supplied to an Addr input terminal of ROM 11.

RAM 13 includes, for example, an entry register and arithmetic operation register and is utilized for time count processing, key input processing, arithmetic operation processing, etc. RAM 13 executes data read/write operation under control of instruction decoder 12. Data which is read out from the DO output terminal of RAM 13 is supplied to "DI-1" and "DI-2" input terminals of ALU 14 and through display control section 16 to display section 17. ALU 14 performs various kinds of operations in accordance with an arithmetic operation instruction from instruction decoder 12. The result of calculation at ALU 14 is read into RAM 13 at the DI input terminal. ALU 14 upon the execution of a "judge" operation supplies a signal representing the presence or absence of the arithmetic operation data and a signal representing the presence or absence of a carry generation, to address control section 15 to permit an address in ROM 11 to be converted. A time count clock of 16 Hz, which is obtained by frequency dividing a reference clock signal from oscillator 18 by means of frequency divider 19, is input to address control section 15 and a time count processing is performed at a rate of one interruption per 1/16 second in accordance with the 16 Hz signal. A signal of a predetermined frequency which is output from frequency divider 19 is fed to timing generator 20. Timing generator 20 delivers various kinds of timing signals to the associated circuits. A key code which is output from key input section 21 is delivered to the DI 2 input terminal of ALU 14.

Figure 4:
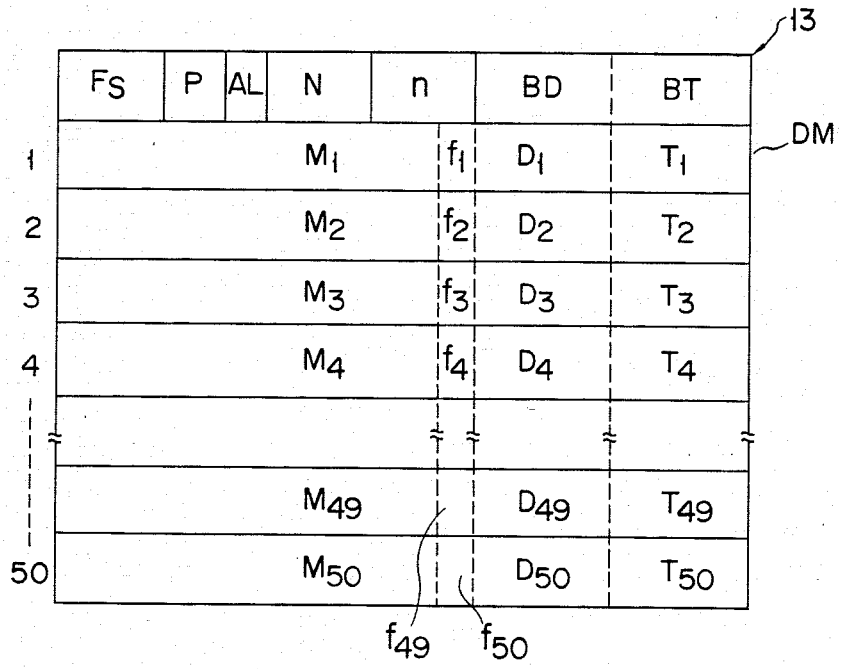
FIG. 4 is a memory map of a RAM in the block circuit diagram shown in FIG. 3.

FIG. 4 shows a memory mapping of a major portion of RAM 13. RAM 13 includes a memory area for permitting not only time count data and system control data, but also the other data to be freely written therein in accordance with key-in data. RAM 13 includes a BD register for counting a present date and storing it therein, BT register for counting a present time and storing it therein, and data memory DM. The data memory DM permits schedule data of 50 pages corresponding to row addresses 1 to 50 to be stored therein. The respective row address areas permit schedule data comprised of month/date data, hour/minute time data and messages (the contents of the schedule) to be stored therein. The messages are stored in the areas $M_1$ to $M_{50}$ on a corresponding row; the date data is stored in the areas $D_1$ to $D_{50}$; and time data is stored in areas $T_1$ to $T_{50}$ in RAM 13. The respective row of the memory map in RAM 13 contains areas $f_1$ to $f_{50}$ for storing the next year data storing flags for the next year schedule. Here, the schedule data is, after being edited or rescheduled in a given sequence, stored in the data memory DM as set out below. RAM 13 includes an address register "n" for designating the row address in the data memory DM, memory N for a whole number of data on the schedule, display page pointer "P", flag register $F_S$ and ON/OFF flag register AL for alarm.

Operation of Wristwatch

The operation of this invention will be explained below with reference to FIGS. 5 to 10.

Figure 5:
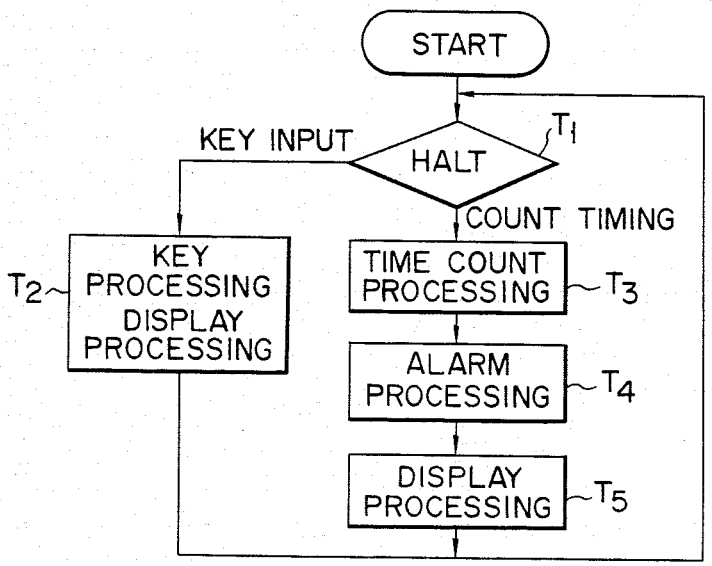
FIG. 5 is a general flowchart of the circuit shown in FIG. 3.

First, the overall operation of the wristwatch will be explained briefly with reference to the general flowchart of FIG. 5. In the flowchart of FIG. 5, step $T_1$ is executed, waiting for a time count timing or for a key-in request. When a key code corresponding to a depressed key is output from key input section 21, then at step $T_2$ a key processing program is designated, executing a key processing or a display processing operation. When a time count clock of 16 Hz is output from frequency divider 19, the process is advanced to step $T_3$ at which a time count processing is executed to permit present time data in the BT register in RAM 13 to be updated. As a result, if a date carry is obtained, the date data in the BD register is updated. At the completion of the time count process, an alarm processing is executed at step $T_4$ and a display processing is performed at step $T_5$.

Figure 6A:
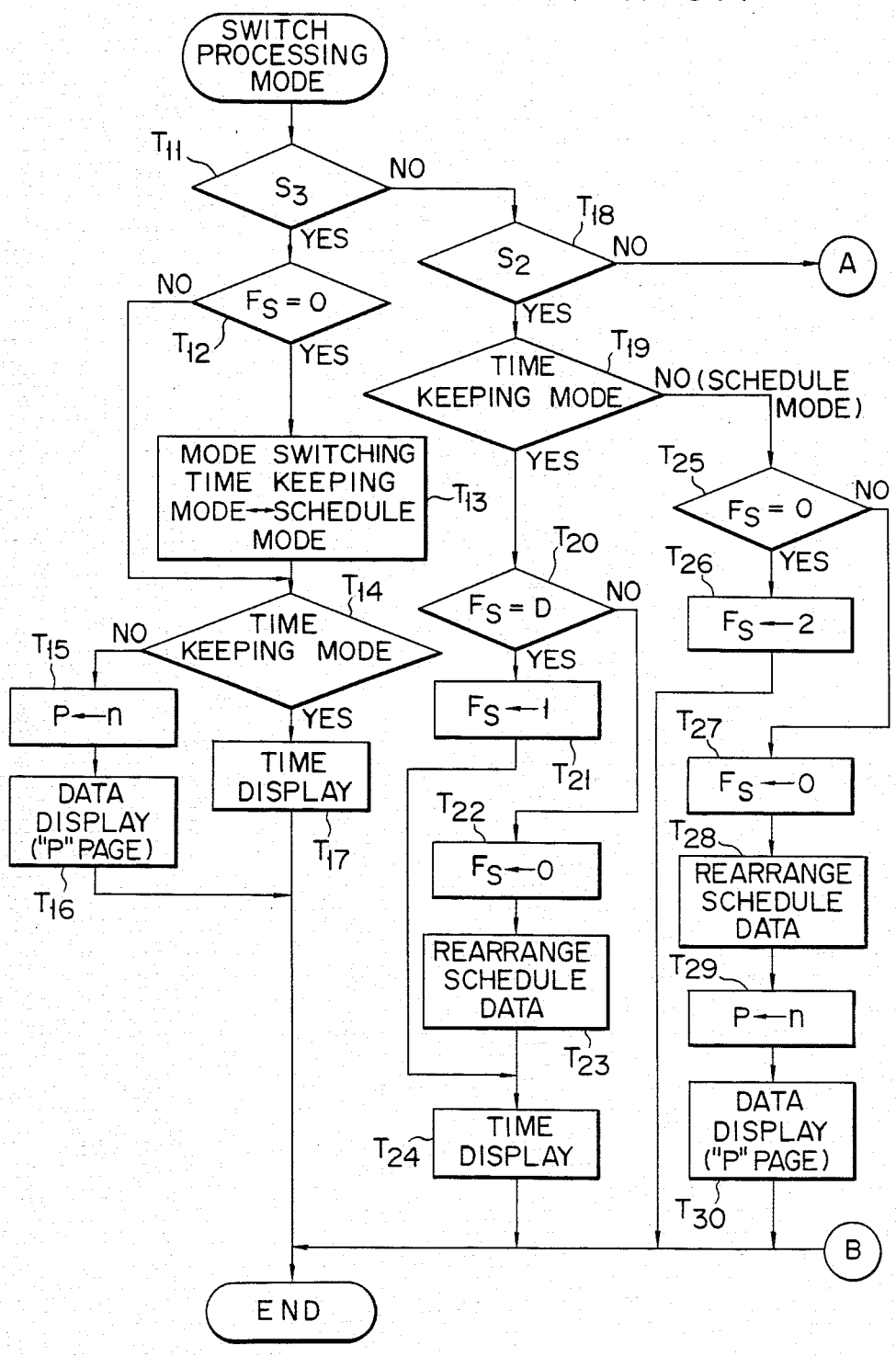
FIGS. 6A and 6B, each, are a detail of step $T_2$ in the general flowchart shown in FIG. 5.
Figure 6B:
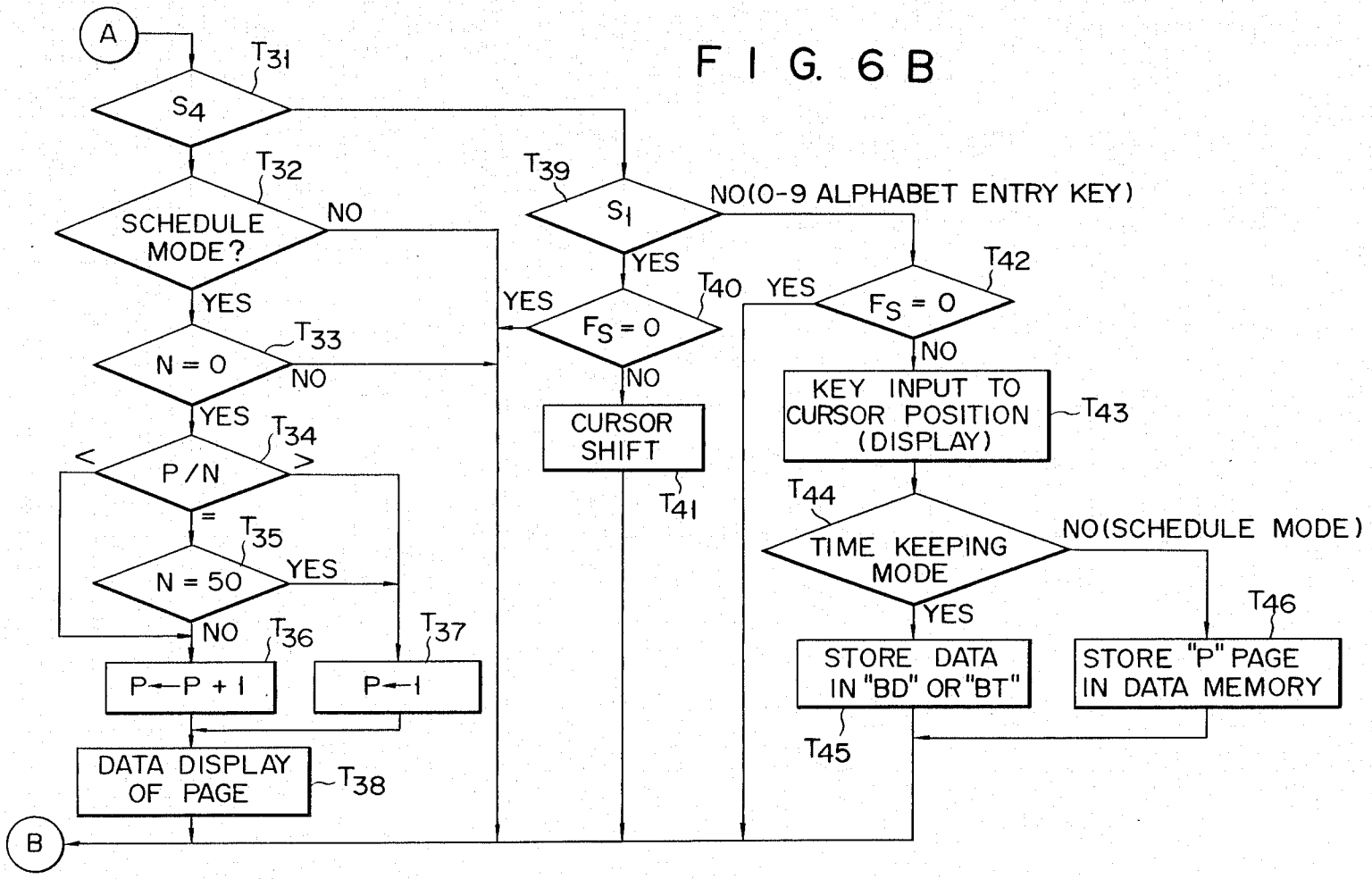

FIGS. 6A and 6B show detailed contents of the key processing and display processing at step $T_2$ in FIG. 5. When the switch $S_3$ is operated so as to perform a switching operation from the time-keeping mode to the schedule mode or from the schedule mode to the time-keeping mode, this operation is detected at step $T_{11}$ and the process goes to step $T_{12}$. At step $T_{12}$, a judgment is made as to whether the contents of the register $F_S$ is "0" or not. When the contents of the register $F_S$ is "1", this means that a flag for designating a write mode is stored in the register $F_S$ for the schedule mode, and a flag for designating a time correction mode is stored in the register $F_S$ for the time-keeping mode. When, on the other hand, the contents of the register $F_S$ is "0", this means that a flag for designating a read mode is stored in the register $F_S$ for the schedule mode, and a flag for designating a normal mode is stored in the register $F_S$ for the time-keeping mode. For the schedule write mode or the time-keeping normal mode the process goes to step $T_{13}$ and a mode, switching is made between the time-keeping mode and the schedule mode. For the schedule write mode or the time correction mode, no mode switching is performed. At step $T_{14}$ the setting mode is identified. For the time-keeping mode the time display is made at step $T_{17}$ and for the schedule mode the value of the address register n is transferred to a display page pointer "P", and the schedule data corresponding to a page indicated by the value of the display page pointer P is read from the data memory DM for display (steps $T_{15}$ and $T_{16}$). In this case, the next announcement number is set in the address register "n".

Stated in more detail, the row address of the data memory DM storing a specified schedule data corresponding to a page to be next announced is set to the address register n, noting that said data memory DM stores a plurality of schedule data including said specified one. For this reason, that schedule data to be next announced is displayed on display section 17. This operation is repeated for each depression of the switch $S_3$, permitting a cyclic switching to be made between the time-keeping mode and the schedule mode.

Figures 9A, 9B, 9C, 9D:
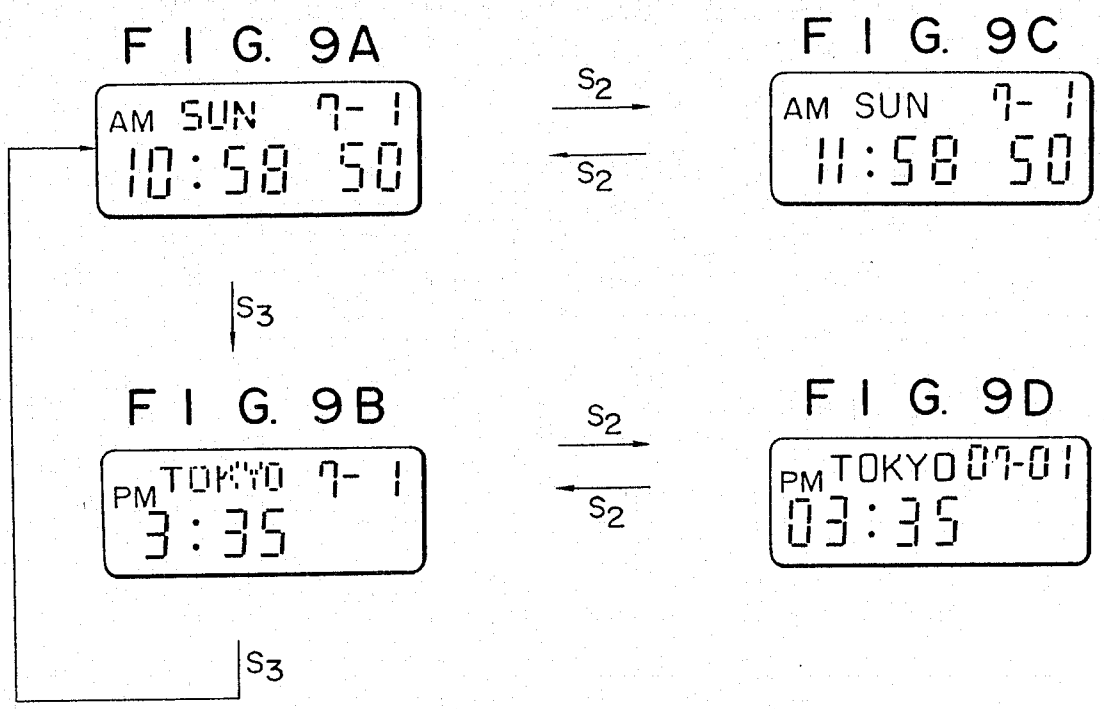

FIGS. 9A and 9B show the display switching states at that time, noting that FIG. 9A shows a time display in the time-keeping mode and FIG. 9B shows a schedule in the schedule mode.

When the switch $S_2$ is operated in the time-keeping mode, the operation of the switch $S_2$ is identified at step $T_{18}$ and the state of a time-keeping mode set is identified at step $T_{19}$. Then the process is advanced to step $T_{20}$. As a result, the contents of the register $F_S$ is rewritten, at $F_S=1$, as being "0" and, at $F_S=0$, as being "1" (steps $T_{21}$ and $T_{22}$).

As shown in FIG. 9, the time correction mode in FIG. 9C is obtained when the switch $S_2$ is operated in the normal mode in FIG. 9A. The normal mode is regained when the switch $S_2$ is operated in the time correction mode.

Only when upon the operation of the switch $S_2$ the time correction mode is switched over to the normal mode, the process goes to step $T_{23}$ where an editing process is executed to permit a rearrangement, or reschedule of the schedule data as set forth later.

When such an editing, or reschedule process is completed or when switching from the normal mode to the time correction mode is completed, the process goes to step $T_{24}$ where the time-of-day data is displayed.

When, on the other hand, the switch $S_2$ is operated in the schedule mode, this operation is detected at steps $T_{18}$ and $T_{19}$ and the same process (steps $T_{25}$ to $T_{28}$) as at steps $T_{20}$ to $T_{28}$ is executed.

As shown in FIG. 9, when the switch $S_2$ is operated in the schedule mode read mode in FIG. 9B the schedule write mode in FIG. 9D is involved. When the switch $S_1$ is operated in the write mode the read mode is obtained. Even in this case, only when switching is made from the write mode to the read mode an editing process for rearranging the schedule data is executed (step $T_{28}$) in the same fashion as set out above. When the editing process is complete, the value (the number to be next announced) of the address register n is transferred to the display page pointer P and the schedule data of a page corresponding to the value of the display page pointer P is displayed (steps $T_{24}$ to $T_{30}$).

Figure 10:
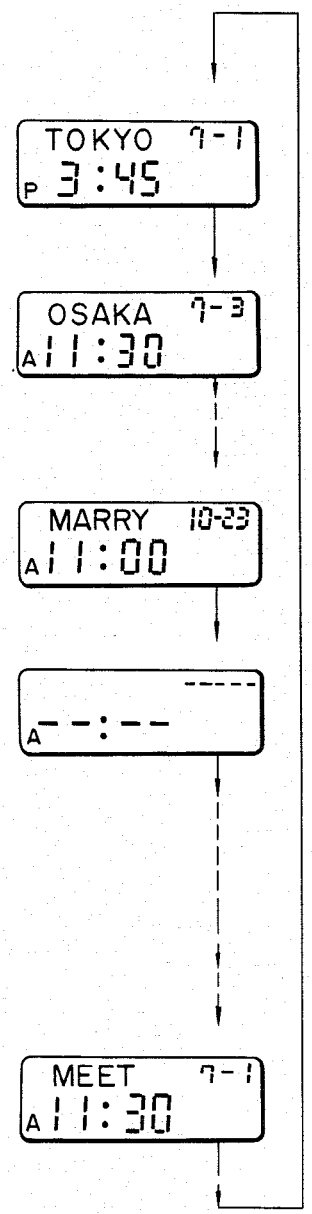

The operation of the timepiece will be explained below in connection with the operation of the switch $S_4$, noting that the switch $S_4$ is operated when in the schedule write and read modes and the display page is switched over to the next page. Upon the operation of the switch $S_4$ this operation is detected at step $T_{31}$. Then the process goes to step $T_{32}$ to examine whether or not the schedule mode is involved. If the time-keeping mode is involved, the switch $S_4$ becomes ineffective and, if in the schedule mode, a process attendant on the subsequent operation of the switch $S_4$ is executed. At step $T_{33}$, a judgment is made as to whether the value of the whole data number memory N is "0" or not, i.e., whether no data is stored in the data memory DM. If even one schedule data is stored in the data memory DM except in the case where no schedule data is stored in the data memory DM, the process goes to step $T_{34}$ at which the data of the display page pointer "P" and the value of the whole data number memory "N" are compared with each other. Now assume that the value of the display page pointer P is equal to the value of the whole data number memory N. Then the process goes to step $T_{35}$ at which a judgment is made as to whether the value of the whole data number memory is "50" or whether a full data state is reached at which the data corresponding to 50 pages are all stored in the data memory DM. Here when at step $T_{34}$ the display page number is detected as being smaller than the whole data number for schedule, data are sequentially stored in the data memory DM. At step $T_{36}$ the value of the display page pointer P is incremented as in the form of $P+1$ and the schedule data corresponding to a page indicated by the value of the display page pointer P is displayed (steps $T_{36}$ and $T_{38}$). Even where the display page number is equal to the whole data number but the data memory DM is not in the data full state, steps $T_{36}$ and $T_{38}$ are executed in which case a display is made as an empty page display. In this way, $+1$ is added to the value of the whole page number pointer P through the operation of the switch $S_4$. Where at step $T_{34}$ the display page number is greater than, or equal to the whole data number but the data memory DM is in the data full date, "1" is set to the display page number pointer P to permit a first page to be displayed (steps $T_{37}$ and $T_{38}$). FIG. 10 shows the states of display mode by the operation of the switch $S_4$. Each time the switch $S_4$ is operated the schedule data in the data memory DM is displayed in a cyclic fashion.

Upon the operation of the switch $S_1$ this operation is detected at step $T_{39}$. This process goes to step $T_{40}$ at which a judgment is made as to whether the contents of the register $F_S$ is "0" or not. If the time correction and schedule modes are involved at $F_S=1$, the cursor is moved by one digit position at step $T_{41}$. In this case, the switch $S_1$ functions as a correction digit selection switch. The operation of the switch $S_1$ becomes ineffective at $F_S=0$. It is to be noted that the selection digit position is clearly displayed in a flashing fashion.

When in the time correction mode or the schedule write mode any of the ten (numeric) keys, together with an alphabet key, is operated for each entry of one character the process goes to steps $T_{39}$ and $T_{42}$ at which a judgment is made as to whether or not $F_S=0$. Since the time correction mode or the schedule write mode is now set, the process goes to step $T_{43}$ at which the key input is completed and the input data is displayed on the cursor position. Thereafter, an examination is made as to whether the time-keeping mode or the schedule mode is involved. Thus the corresponding process is performed (steps $T_{45}$ and $T_{46}$). That is, in the time-keeping mode the input data is stored, as the date data or time data, in the register BD or register BT, respectively, in RAM 13. Since in this way the contents of the registers BD and BT are rearranged, it is possible to perform a date/time correction operation. In the schedule mode the input data is stored as the schedule data in the data memory DM addressed by the value of the display page pointer P. By so doing, the schedule data in the data memory DM can be corrected and new schedule data can be written into the data memory DM. In this case, if the new data is to be written into the data memory, the data may be input thereto after the empty page has be displayed through the operation of the switch $S_4$.

Figure 7:
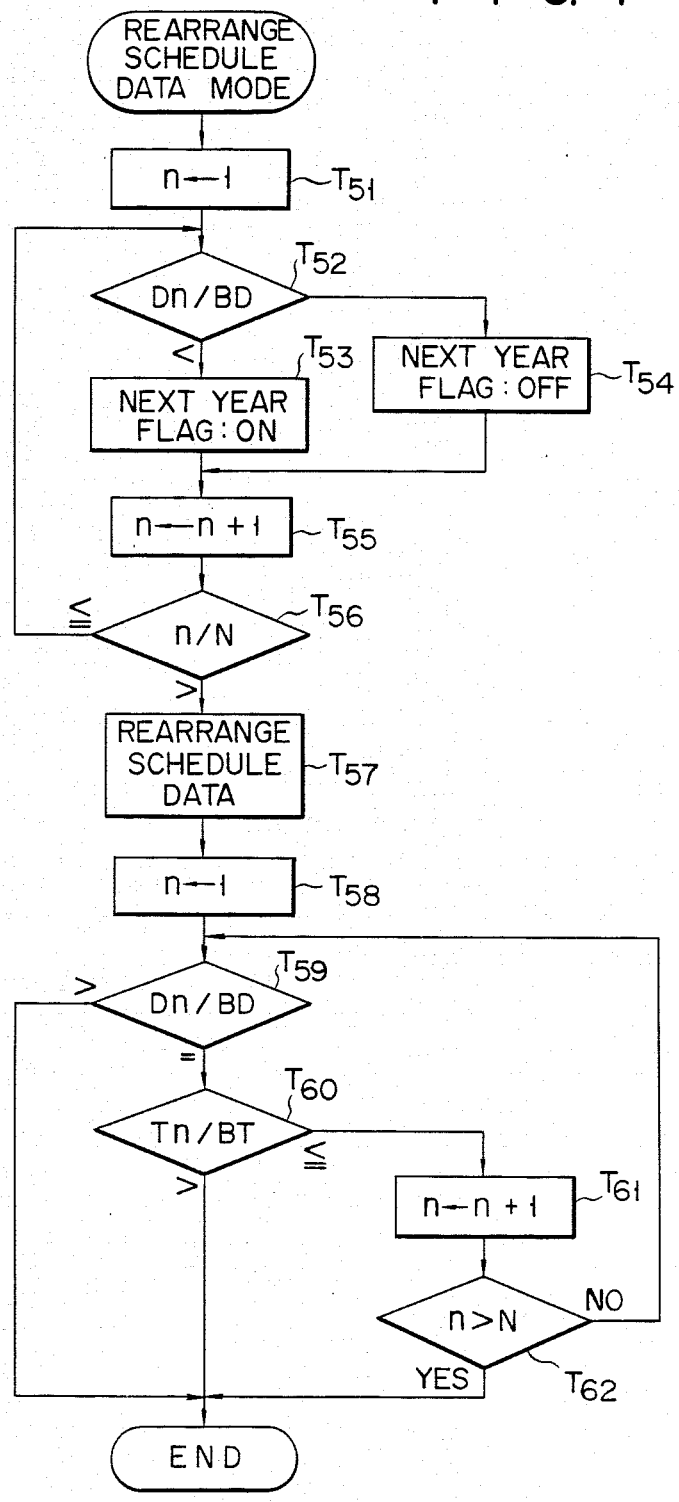
FIG. 7 is a flowchart showing a detail of steps $T_{23}$ and $T_{28}$ shown in FIG. 6A.

FIG. 7 is a flowchart showing a detail of a schedule data rearranging process (steps $T_{23}$ and $T_{28}$) in FIG. 6.

First, an initial value "1" is set to the address register n (step $T_{51}$) Then the process goes to step $T_{52}$ at which a comparison is made between the contents of the register BD and that of one (Dn) of areas $D_1$ to Dn designated by the contents $D_1$ to $D_{50}$ to examine whether or not a present date exceeds a preset date on the schedule. If it exceeds that preset date, the process goes to step $T_{53}$ at which, in order to show that said schedule data belongs in the next year, the next year flag is turned ON to permit "1" to be set to the area "fn" corresponding to the area Dn. If the present date does not exceed said preset date, the process goes to step $T_{54}$ at which the next year flag is turned OFF. At step $T_{55}$, +1 is added to the value of the address register "n" in an incremental step. Then the process goes to step $T_{56}$ at which a comparison is made between the contents of the address register n and that of the whole data number memory N to see if the value of the address register n exceeds that whole data number. If it does not exceed the whole data number, the process goes back to step $T_{52}$ and the aforementioned operation is repeated. As a result, for the respective corresponding schedule data the next flag is turned 0N or OFF in accordance with the present date.

After the next flag has been ON/OFF processed, the process goes to step $T_{57}$ at which the rearrangement, or reschedule of the schedule data is implemented. That is, on the basis of the present date and time the schedule data are rearranged, or rescheduled in a time order of recency. Stated in more detail, where there are a plurality of schedule data, they are rearranged in said time order and the next year schedule data are time-sequentially rearranged after the present year data.

When in this way the contents of the data memory DM are edited, a process for setting the next announcement number to the address register "n" is implemented. Since in this case the schedule data to be next announced is stored in the address "1" of the data memory DM by the aforementioned editing process, "1" is set to the address register "n" (step $T_{58}$). When a plurality of schedule data present on the same day are to be ON/OFF controlled based on the next year flag date, even if the present time exceeds some schedule time, they are edited in said time sequence as set out above without being processed as the next year data. In this case, the next processing is executed so as to update the value of the address register "n". That is, at step $T_{59}$ a comparison is made between the contents of the area Dn and that of the register BD to see whether or not the present date reaches an initial schedule date. If the answer is in the negative, the value of the address register "n" remains "1", but when the preset schedule date is reached the process goes to step T60 at which an examination is made as to whether or not the present time reaches the schedule time. If the answer is in the affirmative, the value of the address register "n" remains to be "1". If, on the other hand, the answer is in the negative, +1 is added to the value of the address register "n" and a comparison is made as to whether or not the contents of the address register "n" exceeds that of the whole number data memory N (steps $T_{61}$ and $T_{62}$). If the answer is in the affirmative, the value of the address register "n" remains unchanged and, if the answer is in the negative the process goes back to step $T_{59}$. Thus the same procedure is executed. By so doing, the next announcement number is set to the address register n.

Figure 8:
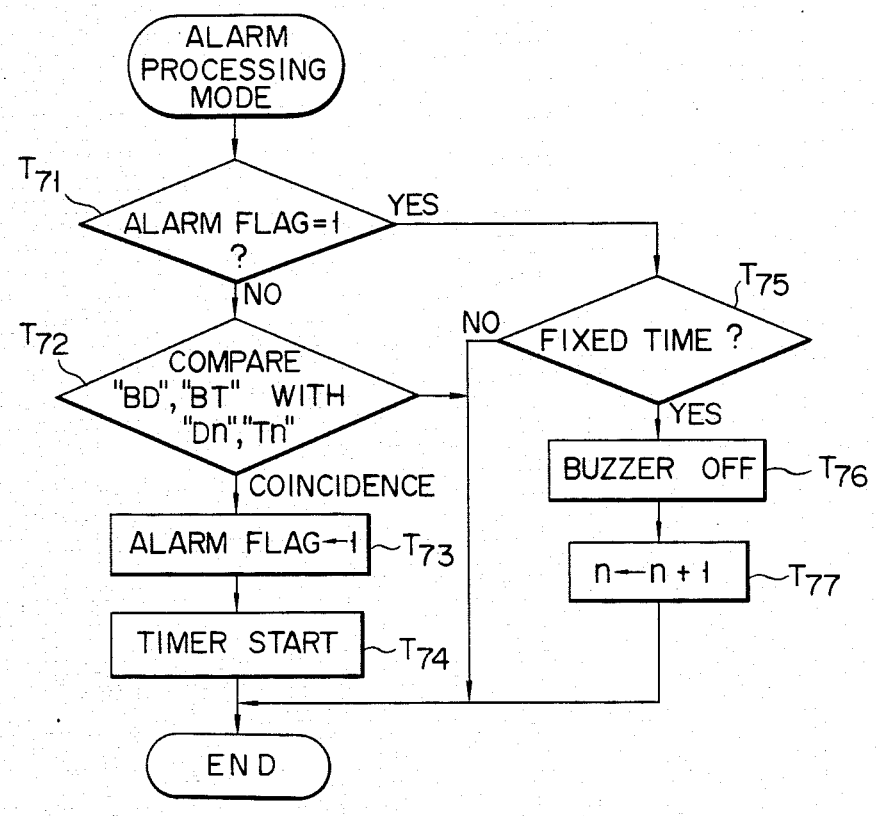
FIG. 8 is a flowchart showing a detail of step $T_4$ in FIG. 5.

FIG. 8 is a flowchart showing a detail of the alarm processing (step $T_4$) shown in FIG. 5. When an alarm processing commences, then the alarm flag is judged as being an ON or OFF state on the basis of the contents of the alarm flag register AL (step $T_{71}$). With the alarm OFF a comparison is made between the present date and time data read out of the registers BD and BT and the schedule date and time data read out of memory areas Dn and Tn which correspond to the next announcement number in the address register, and an examination is made as to whether or not there is an alarm time coincidence (step $T_{72}$). If there is such a time coincidence, then the alarm flag is turned ON and "1" is set to the register AL, starting a timer counter operation (steps $T_{73}$ and $T_{74}$). Simultaneously with the start of the timer a buzzer is turned ON, producing an alarm sound. At the same time the schedule data of a schedule corresponding to the alarm time coincidence is displayed in place of the time data. In this case, the schedule data is displayed and simultaneously transferred to a voice synthesizing circuit (not shown in detail) so that this schedule data sounds as the synthesized voice. Alternatively, this schedule data simply sounds as the synthesized voice. If the alarm time is so reached the alarm flag is turned ON. When an alarm process is again started after 1/16 second, the process goes from step $T_{71}$ to step $T_{75}$ at which a judgment is made as to whether or not a predetermined time is reached. If the answer is in the negative, an alarm sound continues until the predetermined time is reached, and at the same time the schedule data is displayed. When the predetermined time is reached, at step $T_{76}$ the buzzer is turned OFF, stopping an alarm sound. At the next step $T_{77}$ the next announcement number is updated with +1 added to the value of the address register "n". Thereafter, a comparison is made between the present date and time data and the schedule date and time data corresponding to the updated address register "n". Where a coincidence occurs, as explained in connection with FIG. 8 an alarm sound is produced while at the same time the corresponding schedule is displayed. In addition the updating of the address register "n" is performed.

When in this embodiment the time correction mode or schedule write mode are cancelled, then the schedule data is rearranged in a time order of recency. Even if the schedule data are written in an irregular fashion, the respective schedule data is rearranged in the time order of recency with the present date and time as a reference. Since upon the detection of an alarm time coincidence it is only necessary to compare with the present time and date the schedule data indicated by the next announcement number in the address register "n", a process for detecting the alarm time can be efficiently performed even if a greater number of schedule data are stored in the memory.

Modification

Figure 11:
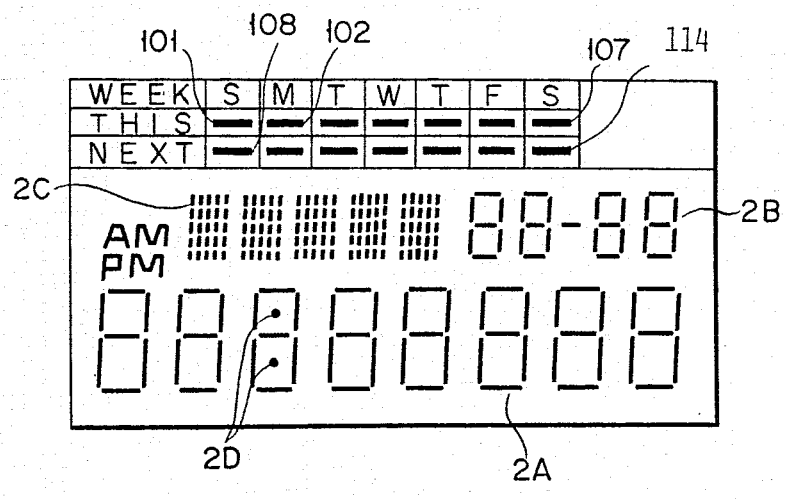
FIG. 11 is a with plan view of segment display device in an electronic timepiece according to another embodiment of this invention.
Figure 12:
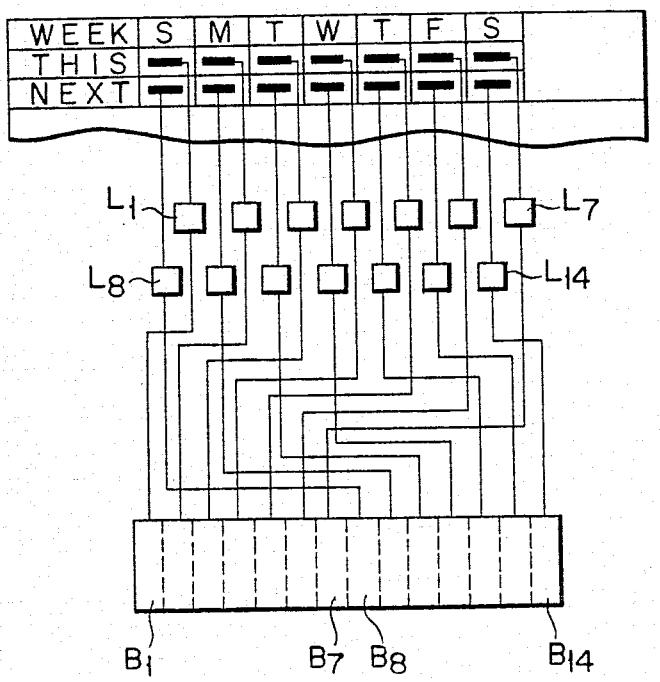
FIG. 12 is a view showing a driving circuit for the display device of FIG. 11.
Figure 13:
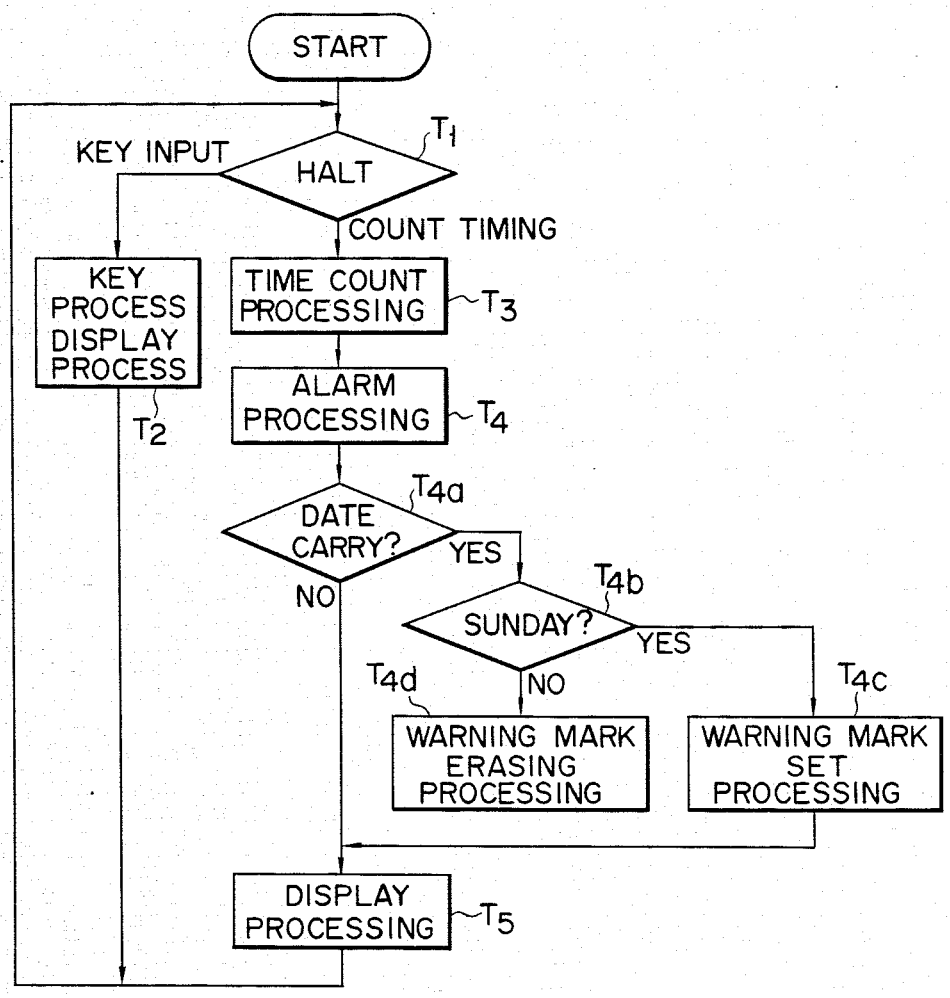
FIG. 13 is a general flowchart of an electronic timepiece equipped with the display device of FIG. 11.

In the embodiment of FIGS. 1 to 10 the preset schedule data is announced when the preset schedule data on the schedule date is reached. However, there are often cases where it is desired to know a schedule before the schedule time is reached. FIGS. 11 to 16 show another modification of this invention. The arrangement of this modification is the same as that set forth in connection with FIGS. 1 to 10, except in the following respects. FIG. 11 shows another form of the display device of FIG. 2. In this form, in addition to digital display sections 2A and 2B and matrix display section 2C, display elements 101 through 114 are provided in a 2-row×7-column dot matrix. The character or legend "THIS" is, for example, printed as indicating "this week" for a corresponding row, and character "NEXT" is, for example, printed as indicating "next week" with characters "S", "M", . . . "S" marked as Sunday, Monday, . . . Saturday for the corresponding columns of the matrix array. As shown in FIG. 12 display elements 101 to 114 are displayed through drivers $L_1$ to $L_{14}$ when "1" is set to registers $B_1$ to $B_{14}$. When the contents of registers $B_1$ to $B_{14}$ correspond to set schedule dates, "1" is stored in registers $B_1$ to $B_{14}$, noting that the setting operation is performed at steps $T_{4a}$ to $T_{4d}$ as shown in FIG. 13. That is, FIG. 13 is a modified form of the general flowchart shown in FIG. 5. At steps $T_3$ and $T_4$ a time count process and alarm process are performed, respectively. At step $T_{4a}$, a judgment is made as to whether or not a date carry is generated in the time count process of step $T_3$. If the answer is in the affirmative, a detection is made as to whether or not the appointed day is Sunday. If said appointed day is Sunday, an alarm mark is set at step $T_{4c}$. The warning mark is set so that, for week days (including the appointed day i.e., Sunday) on which week schedule data are set, "1" is set to the registers $B_1$ to $B_7$ and that, for week days on which the next week schedule data are set, "1" is set to the registers $B_8$ to $B_{14}$.

If at step $T_{4b}$ the appointed day is not Sunday, then "1" stored in the corresponding one of the register $B_1$ to $B_{14}$ is cancelled.

Figure 14:
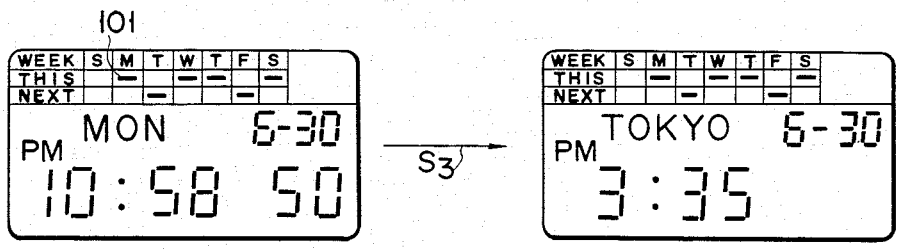
FIGS. 14 to 16 are display panels showing a variation of a display state on the display device.
Figure 15:
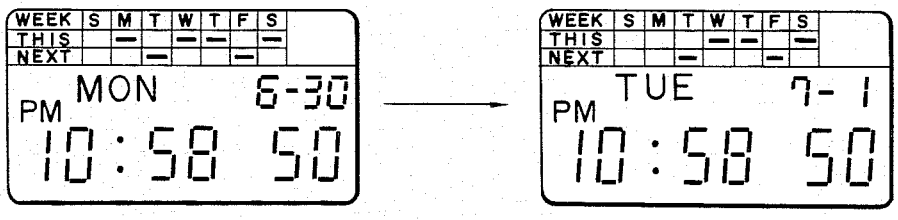

When the appointed day is Monday, June 30, dot matrix display element 101 corresponding to the position of Monday, this week is displayed as shown, for example, in FIG. 14. It is, therefore, possible to know the schedule data on the appointed day and thus to confirm it through the operation of the switch $S_3$.

Figure 16:
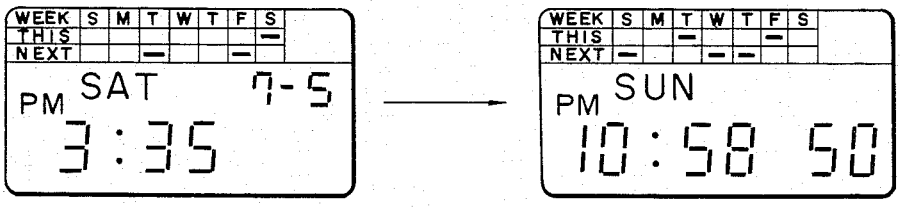

When, in place of Monday, Tuesday is appointed as this day, the warning mark on said Monday, i.e., a spent day disappears. From this it will be found that the next schedule day is next Wednesday. When Sunday, next week, is reached, the schedule warning marks which have been displayed in the "next week" position are shifted to the "this week" position, as shown in FIG. 16, at step $T_{4c}$ at which the "next week" warning marks are displayed. It is, therefore, possible for the user always to know not only the "this week" schedule data but also the "next week" schedule data.

In the embodiments previously described with reference to FIGS. 11 through 16, the indication of the schedule displayed on the wrist-watch covers a two week schedule data. It is, of course, possible to display play more schedule indications than a two week schedule. Also, with every operation of the external operation switch, the schedule data succeeding the "next week" schedule data may be sequentially displayed on the dot matrix display 2C as shown in FIG. 11.

As previously described in the first and second embodiments with reference to FIGS. 1 to 10 and FIGS. 11 to 16, respectively, the schedule data were visually displayed on the display device 2. Alternatively, these schedule data may be printed out by a printer (not shown in detail). In this case, a key switch (not shown) is provided on this printer for entering data. Accordingly, it is very convenient to print out the schedule data succeeding to those entered by the key switch.

Although in the aforementioned embodiment this invention has been explained as having been applied to a wristwatch, it can be applied to any other type of time keeper, compact type electronic computer and other electronic apparatus.

What is claimed is:

1. An electronic time-keeping apparatus, comprising:

means for generating reference signals;

time data memory means including counting means for counting the reference signals, for storing present time and date data;

schedule data input means for inputting schedule data including at least time and date data and information data;

schedule data memory means having a number of data memory regions, for storing the schedule data input by said schedule data input means, said data memory regions permitting the schedule data containing dates to be stored according to a time sequence of recency with respect to the present time and date;

address data memory means for storing address data of a date memory region among the data regions of said schedule data memory means, in which region schedule data containing time and date data following and nearest to said present time and date data has been stored;

coincidence detection means for detecting, after a counting operation of the present time and date data is completed by said counting means, a coincidence between said present time and date data and the date data of schedule data located in a data memory region designated by said address data stored in said address data memory means, without detecting a coincidence between said present time and date data and schedule data stored in other data memory regions; and announcement means for updating the address data of said address data memory means when a coincidence is detected by said coincidence detection means and for announcing the coincidence thus detected.

2. An electronic time-keeping apparatus according to claim 1, comprising optical dispaly means for displaying date information stored in said time data memory means, and means for displaying said schedule data alternatively to the data information on said optical display means.

3. An electronic time-keeping apparatus according to claim 1, including display control means for time-sequentially displaying, in accordance with a time sequence of recency, the schedule data previously stored in each of the data memory regions of said schedule data memory means with respect to said present time.

4. An electronic time-keeping apparatus according to claim 3, wherein said display control means includes an external operation switch for reading out the schedule data stored in each data memory region of said schedule data memory means.

5. An electronic time-keeping apparatus according to claim 1, including a read only memory for storing a microprogram to control the coincidence detection operation of said coincidence detection means.

6. An electronic time-keeping apparatus according to claim 1, comprising printing means for printing out schedule data stored in said schedule data memory means.

7. An electronic time-keeping apparatus according to claim 1, comprising week schedule memory means for storing weekly schedule data covering at least one week incluidng said present date, said weekly schedule data being among the schedule data stored in said schedule data storing means; and display means for displaying the weekly schedule data which have been stored in said week schedule memory means.

8. An electronic time-keeping apparatus according to claim 7, wherein said display means comprises matrix type display elements for displaying successive weeks and week days.

9. An electronic time-keeping apparatus according to claim 7, including update means for updating the contents of said week schedule memory means for each week.

10. An electronic time-keeping apparatus according to claim 9, wherein said update means includes means for performing an update operation at an end of each Saturday.

11. An electronic time-keeping apparatus according to claim 9, wherein said update means includes erasing means for erasing the contents of said week schedule memory means at an end of each date in said schedule data.

12. An electronic time-keeping apparatus according to claim 8, wherein said matrix display elements are arranged to display the presence or absence of schedule data covering at least two weeks.

13. An electronic time-keeping apparatus according to claim 1, including time display means for displaying present date data stored in said time data memory means, and for displaying said present date data together with schedule data covering one week on said display means.

14. A method of detecting alarm time data, wherein alarm time memory means having a number of data memory regions is used for storing a number of pieces of alarm time data containing date and time data, and a coincidence is checked between present date and time data and any one of said pieces of alarm time data stored in the alarm time memory means, comprising:

executing a time measurement operation at predetermined intervals to obtain present date data and time data;

inputting the alarm time data to be stored in the data memory regions of said alarm time memory means by input means;

editing the alarm time data input by said input means and alarm time data previously stored in said alarm time memory means according to a time sequence of recency with respect to said present date data, and storing the edited alarm time data in said data memory regions;

storing in address memory means, address data of a data memory region among the data memory regions used for storing the alarm time data, in which region alarm time data following and nearest to said present date and time data has been stored;

detecting a coincidence between said present date and time data, and the alarm time data stored in the data memory region designated by the address data stored in said address memory means; and updating the address data stored in said address memory means according to the results of said detecting step, thereby enabling a coincidence between the present date and time data, and alarm time data stored in a next data memory region to be detected when repeating said detecting step.

15. A method according to claim 14, including storing schedule data corresponding to the alarm time data in a memory area associated with each of said data memory regions.

16. A method according to claim 14, including ending the input of the alarm time data during said data input step by operating an external operation switch, thereby initiating said editing step in response to an operation signal of the external operation switch.

17. A method according to claim 14, including displaying on display means the present date and time data obtained by said time measurement step, and the alarm time data of each data memory region as edited by said editing step.

18. A method according to claim 17, comprising alternatively displaying the alarm time data stored in each data memory region on said display means by operating an alternative display switch.

* * * * *